US005937484A

United States Patent [19]

Sramek et al.

[11] Patent Number: 5,937,484

[45] Date of Patent: Aug. 17, 1999

[54] FLAT CONTAINER OF TEXTILE FIBRE SLIVER

[75] Inventors: Rudolf Sramek, Cvicna; Ludmila Koukolikova, Donska, both of Czech Rep.

[73] Assignees: Rieter Elitex a.s. Usti nad Orlici; Vyzkumny ustav textilnich stroju Liberec a.s, both of Czech Rep.

[21] Appl. No.: 08/868,868

[22] Filed: Jun. 4, 1997

[30] Foreign Application Priority Data

Jun. 7, 1996 [CZ] Czech Rep. ..... PV 1662-96

[51] Int. Cl.[6] ..... D04H 11/00

[52] U.S. Cl. ..... 19/159 R; 19/159 A; 57/90; 57/268; 57/281

[58] Field of Search ..... 57/1 R, 90, 264, 57/268, 281; 19/159 A, 159 R; 206/388

[56] References Cited

U.S. PATENT DOCUMENTS

| | | | |
|---|---|---|---|
| 3,302,955 | 2/1967 | Witzgall | 19/159 R |
| 3,489,473 | 1/1970 | Goodwin et al. | 19/159 R |
| 3,612,457 | 10/1971 | Morikawa | 19/159 A |
| 3,614,814 | 10/1971 | Araki et al. | 19/159 R |
| 4,196,498 | 4/1980 | Kriechbaum et al. | 19/159 R |
| 4,261,079 | 4/1981 | Masini et al. | 19/149 R |

FOREIGN PATENT DOCUMENTS

| | | | |
|---|---|---|---|
| 0280616 | 11/1994 | Czech Rep. . | |
| 0344484 | 12/1989 | European Pat. Off. . | |
| 2712982 | 10/1978 | Germany | 19/159 R |
| 139022 | 1/1975 | United Kingdom | 19/159 R |

*Primary Examiner*—William Stryjewski

*Attorney, Agent, or Firm*—Ostrolenk, Faber, Gerb & Soffen, LLP

[57] ABSTRACT

A flat container of textile fiber sliver for receiving a sliver produced on a sliver producing textile machine and for feeding the sliver to a sliver processing machine taking over the sliver. The flat container has a movable bottom adapted to move vertically in the flat container, and includes an upper plate arranged adjustably and intended to receive the sliver being deposited, and a lower plate situated under the upper plate and likewise arranged adjustably. The upper plate and the lower plate are mutually coupled by an auxiliary coupling device permitting a common motion and independent motion of the upper and lower plates of the movable bottom.

7 Claims, 6 Drawing Sheets

FLAT CONTAINER OF TEXTILE FIBRE SLIVER

TECHNICAL FIELD

The invention relates to a flat container of textile fibre sliver for receiving a sliver produced on a sliver producing textile machine and for feeding the sliver to a sliver processing machine taking over the sliver, the container having a movable bottom adapted to move vertically in the container.

BACKGROUND OF THE INVENTION

Currently, the sliver produced on sliver producing textile machines is deposited especially in cylindrical containers fitted with a movable bottom actuated by a pressure spring situated under the bottom and lifting the bottom of the container, when the latter is empty, almost to the upper edge of the container and compressed by the bottom downwards as the sliver is gradually deposited on the movable bottom of the container. When the containers are full, i.e., filled with the sliver, they are moved to a sliver processing machine such as an open-end spinning machine where the sliver is gradually taken from the container and the bottom correspondingly moves upwards due to the decreasing weight of the sliver amount deposited in and gradually leaving the container. Due to this, the sliver is at all times taken from the upper section of the inner space of the container, and the sliver end, due to a possible sliver interruption, is accessible to the operator.

The drawback of these cylindrical containers consists in their limited capacity determined by the maximum diameter allowing to place them under the operating units of the sliver processing machines. To achieve the maximum capacity, the cylindrical containers must be arranged partly one behind the other in order to permit their diameter to be equal to almost the double of the spacing between the operating units of the machine. Such arrangement of the cylindrical containers is a serious impediment to the possibility of replacing automatically an emptied container by a full one, the replacement of the rear container requiring the handling of two containers. Consequently, the attempts to automize this process have failed, and said exchange of the cylindrical containers is carried out manually. However, even the manual exchange requires the operator to handle at least one additional container.

Especially for these reasons, more advantageous are flat sliver containers whose width corresponds to the width of one operating unit of a spinning machine minus a necessary handling gap, and the width, at least to the width of the machine space under the operating units. Such flat containers have been coming into use in particular in the rotor spinning machines with automatic container exchange but due to their advantages are likely to replace the cylindrical sliver containers in other types of spinning machines as well.

From the point of view of the motion and construction of the bottom of the flat container of the textile fibre sliver, the currently used flat containers can be divided into two groups. To the first group belong flat containers whose bottom, like that of the cylindrical containers, is seated on compressible spiral sprins. To prevent the movable bottom of the flat container from sinking unevenly on the mutually opposed bottom edges in its longitudinal direction, a well-known lever mechanism, disclosed for instance in EP 344 484, can be situated between said spiral springs. In the crossing points of the lever mechanisms there are horizontally and at the respective crossing point rotatably mounted reinforcing members whose ends are connected by means of a joint with the respective opposed spiral spring.

This arrangement of the flat container involves problems during the feeding of a fully loaded container. The sliver is deposited into the container under pressure and therefore comes to reach over the upper edge of the flat container with the risk for the upper layers of the sliver to fall down or to get caught during the feeding, and for the sliver, to get damaged or interrupted. The upper layer has limited stability in the direction normal to the longitudinal axis plane of the flat container which is in most cases the direction the flat containers move in while being fed. The material reaching over the upper edge of the container is source of troubles while the sliver is being taken out of the container under a spinning machine, and this problem requires solution for instance by increasing the height of the machine or by reducing the height of the container. In this flat container, the pressure exerted on the sliver while being deposited into the container can be neither changed nor regulated.

In the second group of flat containers, disclosed for instance in the patent CZ 280616, the bottom adapted freely to move vertically consists of a plate. Before the start of the sliver filling process, a lifting device moves the bottom towards the upper edge of the flat container; then, during the filling process, the bottom sinks as far as to the lower edge of the container reached when the flat container is completely full.

The drawback of this solution consists in particular in the fact that the bottom of the flat container constantly remains in its lower position while the sliver is being taken off under a spinning machine. The relation between the height and width of the flat container renders it very difficult for the machine operator to find in, and to pick out from, the flat container the sliver end, if the sliver interruption occurs with the flat container less than half-filled.

DISCLOSURE OF THE INVENTION

The above drawbacks of the state of art have been done away with by a fibre sliver flat container comprising a movable bottom, the principle of the invention consisting in that the movable bottom of the flat container comprises an upper plate arranged adjustably in vertical direction, and a lower plate, situated under the upper plate and likewise arranged adjustably in vertical direction, the upper and the lower plate being mutually coupled by an auxiliary coupling means permitting a common and/or mutual motion of the upper plate and of the lower plate, of the movable bottom.

This arrangement of the movable bottom of the fibre sliver flat container permits, among others, to optimize the height of the sliver upper layer when the sliver is taken out of the container on a sliver processing machine so that said upper layer of the sliver in the flat container is at all times situated at a height accessible to the operator when a sliver rupture occurs.

Preferably, the auxiliary coupling means contains at least one resilient member situated between the upper plate and the lower plate of the movable bottom.

Preferably, the auxiliary coupling means also comprises at least one spacing member situated between the upper plate and the lower plate of the movable bottom and defining at least their maximum distance.

The effect reached by the invention is best when the maximum distance between the upper and the lower plate lies within 30 to 70% of the height of the flat sliver container.

The advantage of the flat container according to the invention consists in the optimum filling, trouble-free feeding, and easy accessibility for the operator of the sliver end in the flat container under the spinning machine.

DESCRIPTION OF THE DRAWINGS

An example of embodiment of the flat sliver container according to the invention is schematically shown in the enclosed drawing in which.

EXAMPLES OF EMBODIMENT

Figure 6:
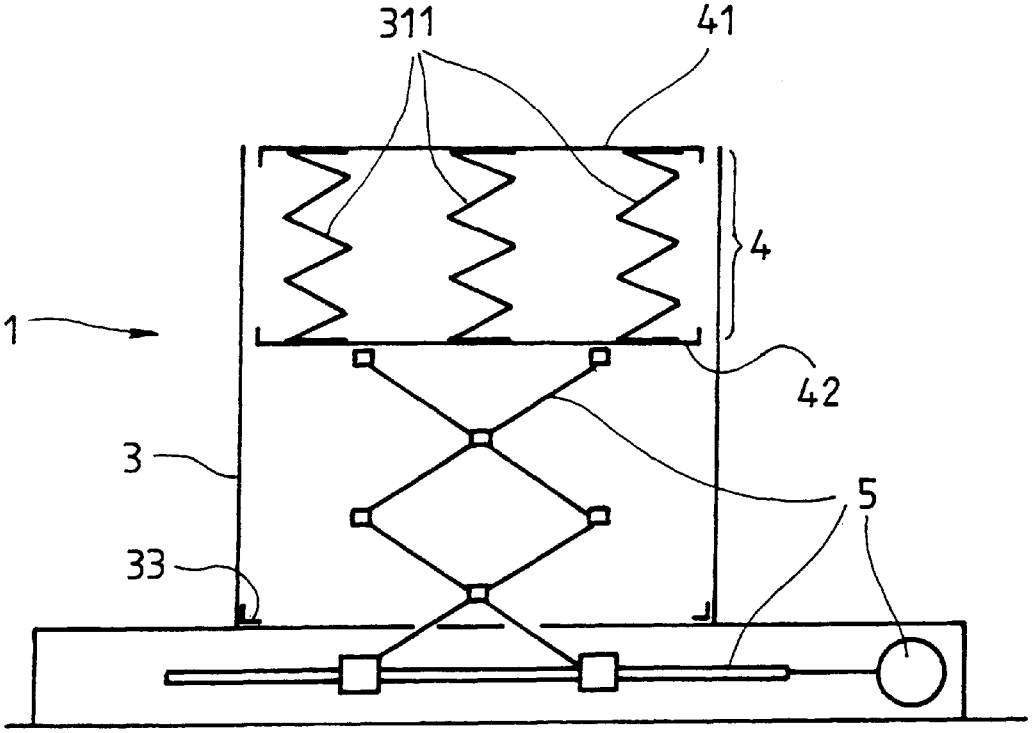
FIG. 6 shows a conventional mechanism for controlling the motion of the movable bottom of the flat container.

A flat container 1 of a sliver 2 comprises a circumferential jacket 3 closing the inner space of the flat container 1 used to receive the sliver 2. In its upper part, the circumferential jacket 3 defines an upper aperture 31 for inserting or taking out the sliver 2. Inside said circumferential jacket 3, a movable bottom 4 of the flat container 1 is seated adjustably in the vertical direction. In its lower part, the circumferential jacket 3 defines a lower aperture 32 providing access for a well-known mechanism 5, FIG. 6, controlling the motion of the movable bottom 4 of the flat container 1 of a well-known sliver producing textile machine. Provided on the lower section of the circumferential jacket 3 there are stops 33 used to support the movable bottom 4 and to prevent it from falling down through the lower aperture 32.

The movable bottom 4 of the flat container 1 comprises an upper plate 41 adjustably situated inside the circumferential jacket 3 of the flat container 1, and a lower plate 42 situated, likewise adjustably, under the upper plate 41. The upper plate 41 and the lower plate 42, of the movable bottom 4 of the flat container 1 are coupled with each other by auxiliary coupling means 43 consisting in the example of embodiment shown in FIGS. 1 and 4 of spiral pressure springs 431 whose upper ends are connected with the upper plate 41 of the movable bottom 4 and whose lower ends are connected with the lower plate 42 of the movable bottom 4. This enables a common motion of the upper plate 41 and also a mutual motion of said plates 41, 42. At least the upper plate 41 of the movable bottom 4 is fitted with downwardly oriented border 411 intended to facilitate the guiding of the upper plate 41 in the inner space of the circumferential jacket 3 of the flat container 1.

Figure 2:
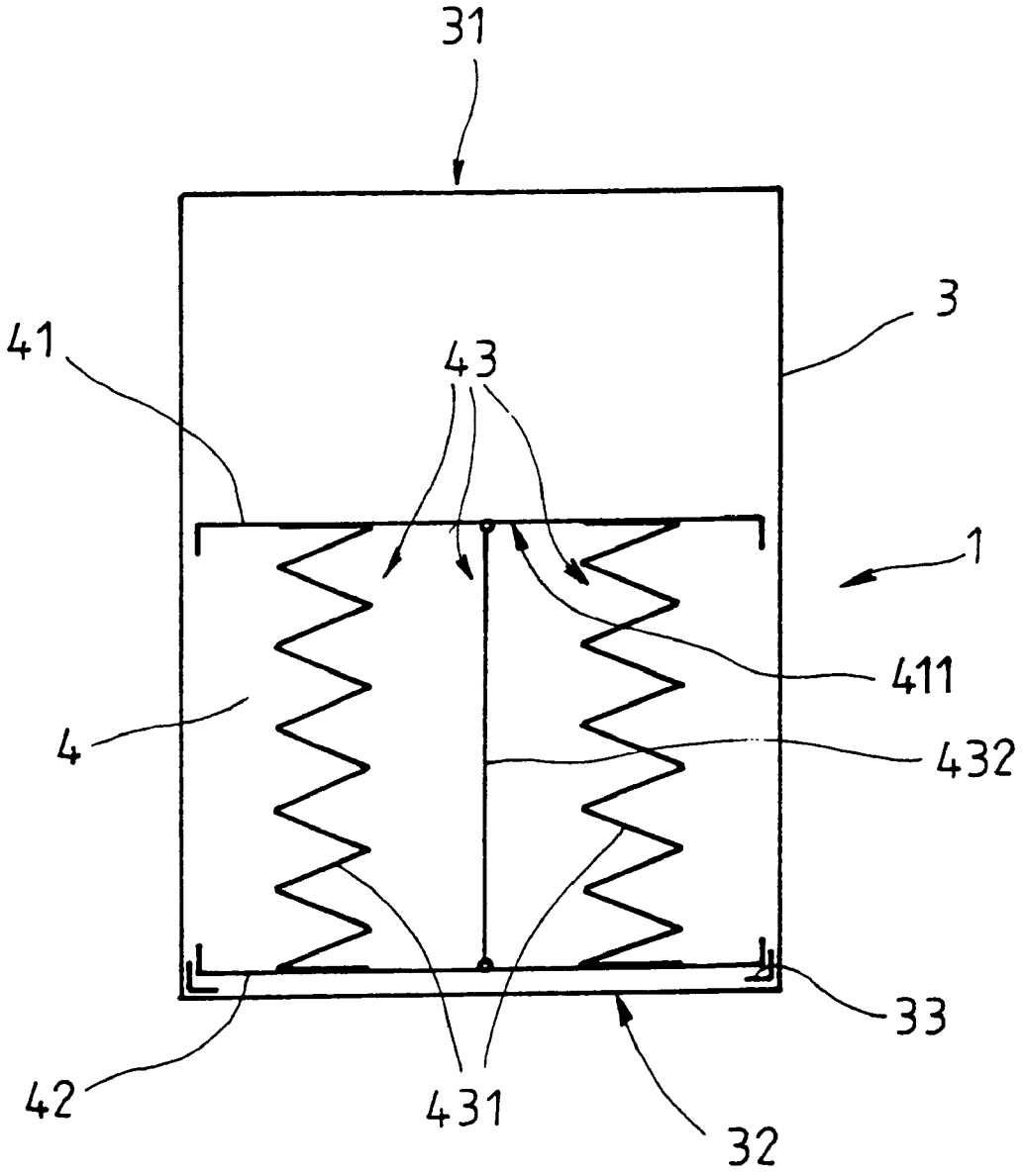

In another example of the embodiment shown in FIG. 2, the auxiliary coupling means again comprise spiral pressure springs 431 situated between the upper plate 41 and the lower plate 42 of the movable bottom 4, and the upper plate 41 is coupled with the lower plate 42 by means of at least one spacing member 432 defining the maximum distance between the upper plate 41 and the lower plate 42 while at the same time permitting said plates 41, 42 to move independently of each other. The spacing member 432 can consist for instance of a chain, wire, etc., whose ends are fixed to said plates 41, 42, or for instance of a bar whose one end is seated for instance on the upper plate 41 and whose the other end is by well-known means slidingly and rotatably mounted on the lower plate 42. The length of the spacing member 432 defines the maximum distance between the upper plate and the lower plate 42 of the movable bottom 4 of the flat container 1.

Figure 3:
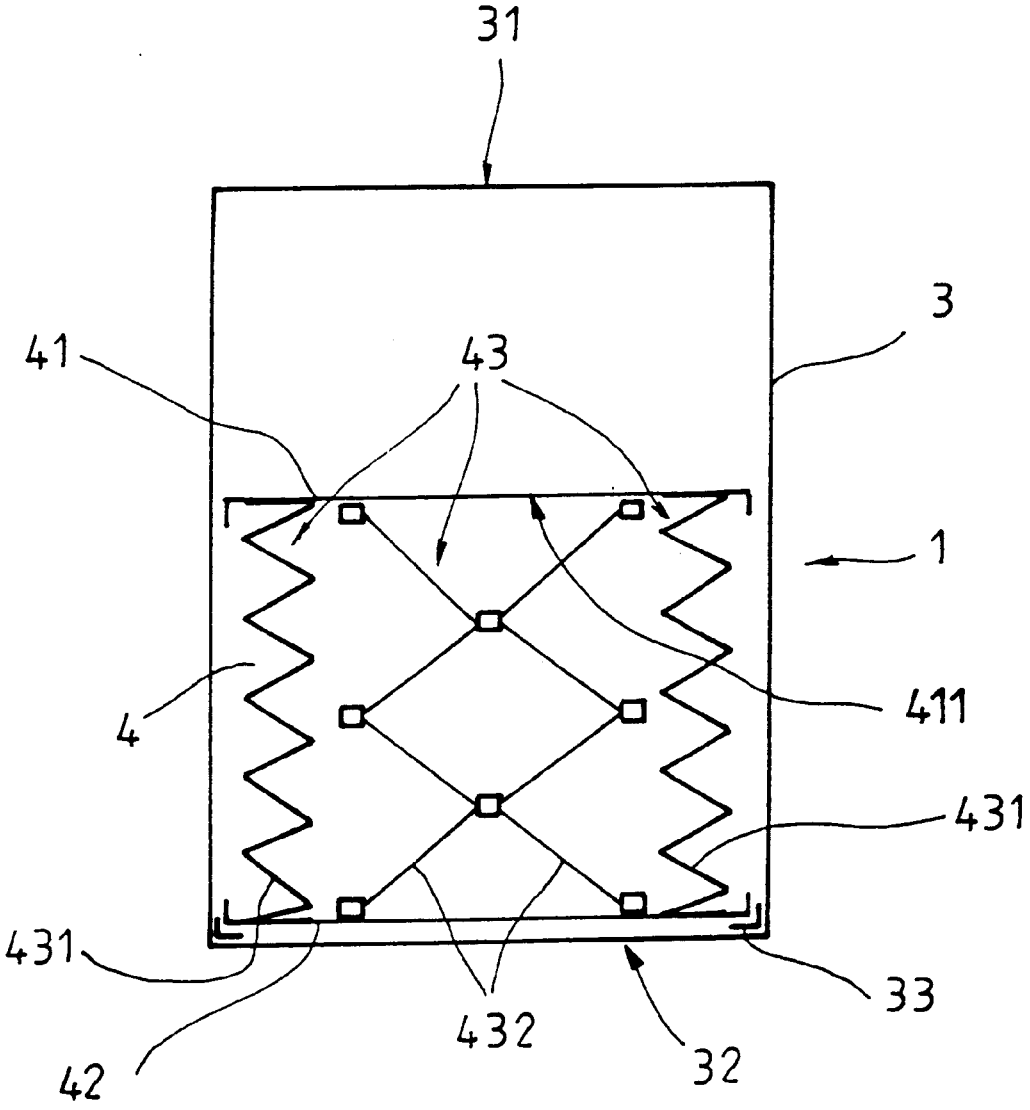

In the example of embodiment shown in FIG. 3, the auxiliary coupling means 43 comprise spiral pressure springs 431 situated between the upper plate 41 and the lower plate 42 of the movable bottom 4, and the upper plate 41 is coupled with the lower plate 42 by means of a well-known lever mechanism consisting of a spacing member and ensuring not only the maximum distance between the two plates 41, 42 of the movable bottom 4 but also the parallelism between them during their mutual motion. In this embodiment, the spiral springs can be replaced by springs mounted on the levers of the lever mechanism.

The auxiliary coupling means 43 between the upper plate 41 and the lower plate 42, of the movable bottom 4 can consist of any well-known suitable compressible means such as rubber, foam rubber, in combination with at least one spacing member 432.

Figure 1:
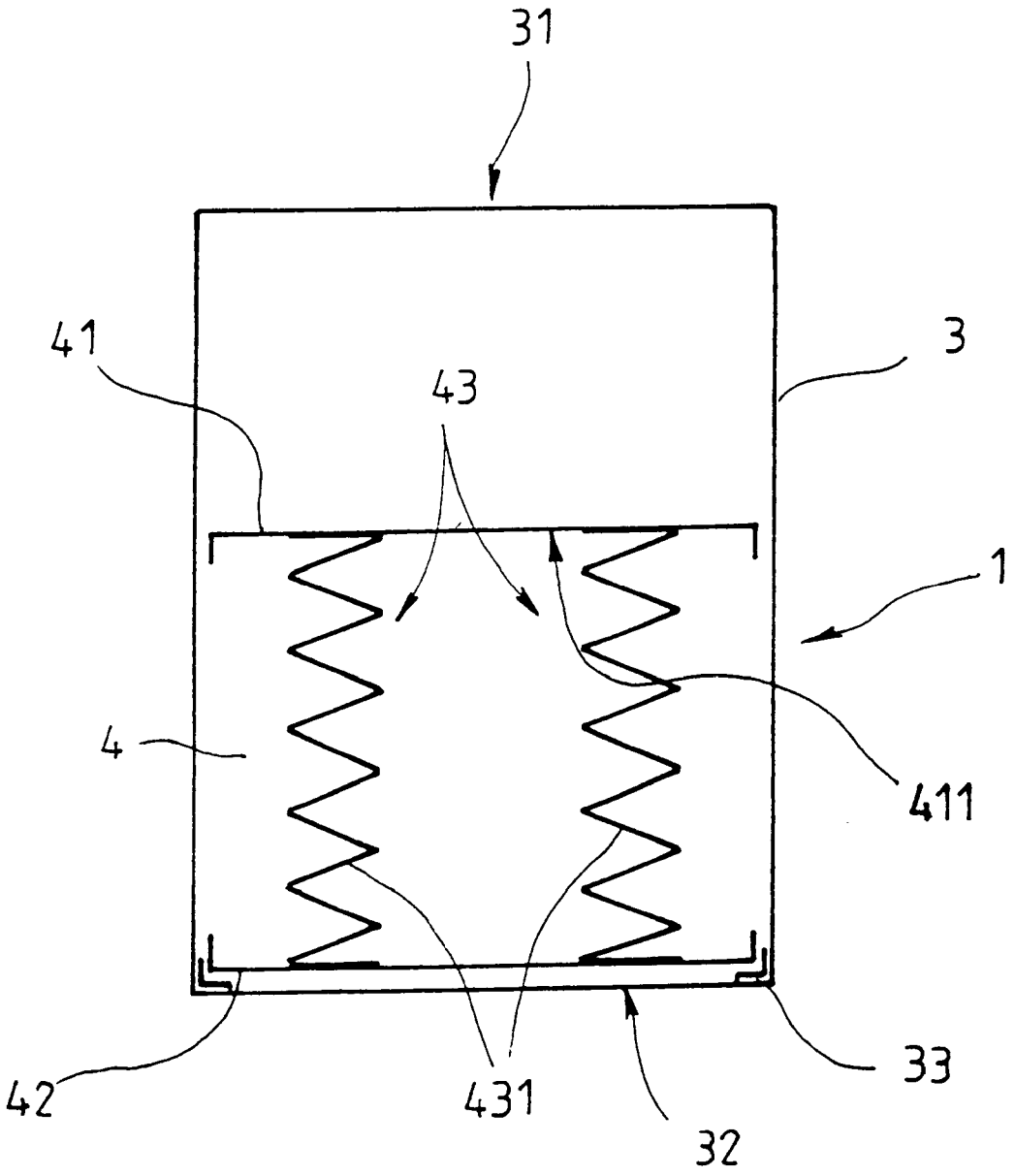
FIG. 1 shows a vertical longitudinal sectional view of the flat container, FIG. 2 a variant in which the auxiliary coupling means of the upper and the lower plate of the movable bottom consists of a wire, FIG. 3 another variant in which the auxiliary coupling means of the upper and the lower plate of the movable bottom consists of a lever mechanism, FIG. 4 the container according to FIG. 1 filled with sliver, FIG. 5 the container according to FIG. 1 while the sliver is being taken out of the container.

If the flat container 1 is empty, the movable bottom is in its lower free position in which the lower plate 42 bears on the stops 33, the spiral pressure springs 431 are released and hold the upper plate 41 of the movable bottom 4 in its rest position at the maximum distance from the lower plate 42 of the movable bottom 4, said maximum distance being 30 to 70 percent of the height of the flat container 1, depending on the construction of the flat container 1 and on the kind of the material it is used for, as shown in FIGS. 1 to 3.

During the process of filling of the flat container 1, the movable bottom 4 is operated by means of a well-known lifting device 5 (FIG. 6) of a well-known filling station, the lower plate 42 being either in contact with said lifting device 5 of the filling station or coupled with said lifting device 5. During the process of filling of the flat container 1 with the sliver 2, said lifting device 5 moves the lower plate 42 of the movable bottom 4 of the flat container 1 to its lower position.

Figure 4:
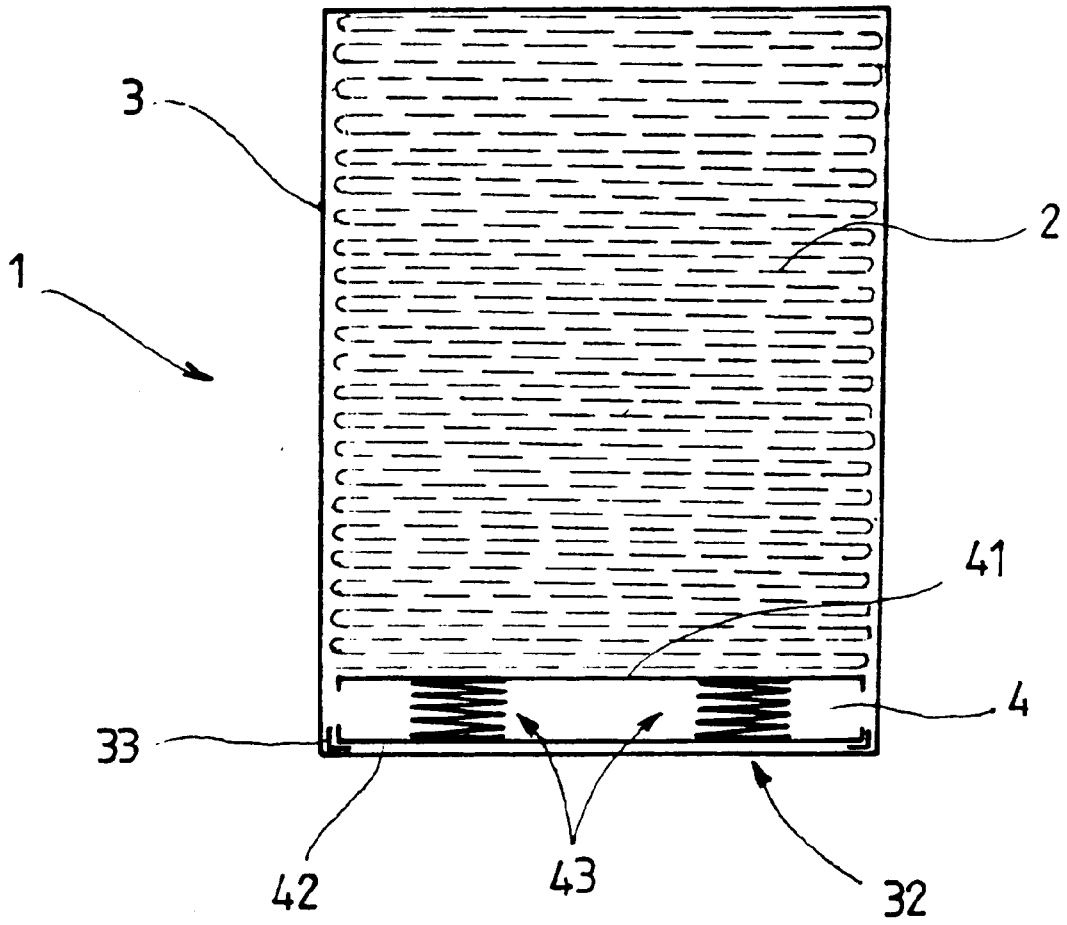

When the flat container 1 is filled with the sliver 2 to the full of its capacity, the lower plate 42 of the movable bottom 4 bears on the stops 33 while the upper plate 41 of the movable bottom 4 is in its depressed position at the minimum distance from the upper plate 42 as shown in FIG. 4.

Figure 5:
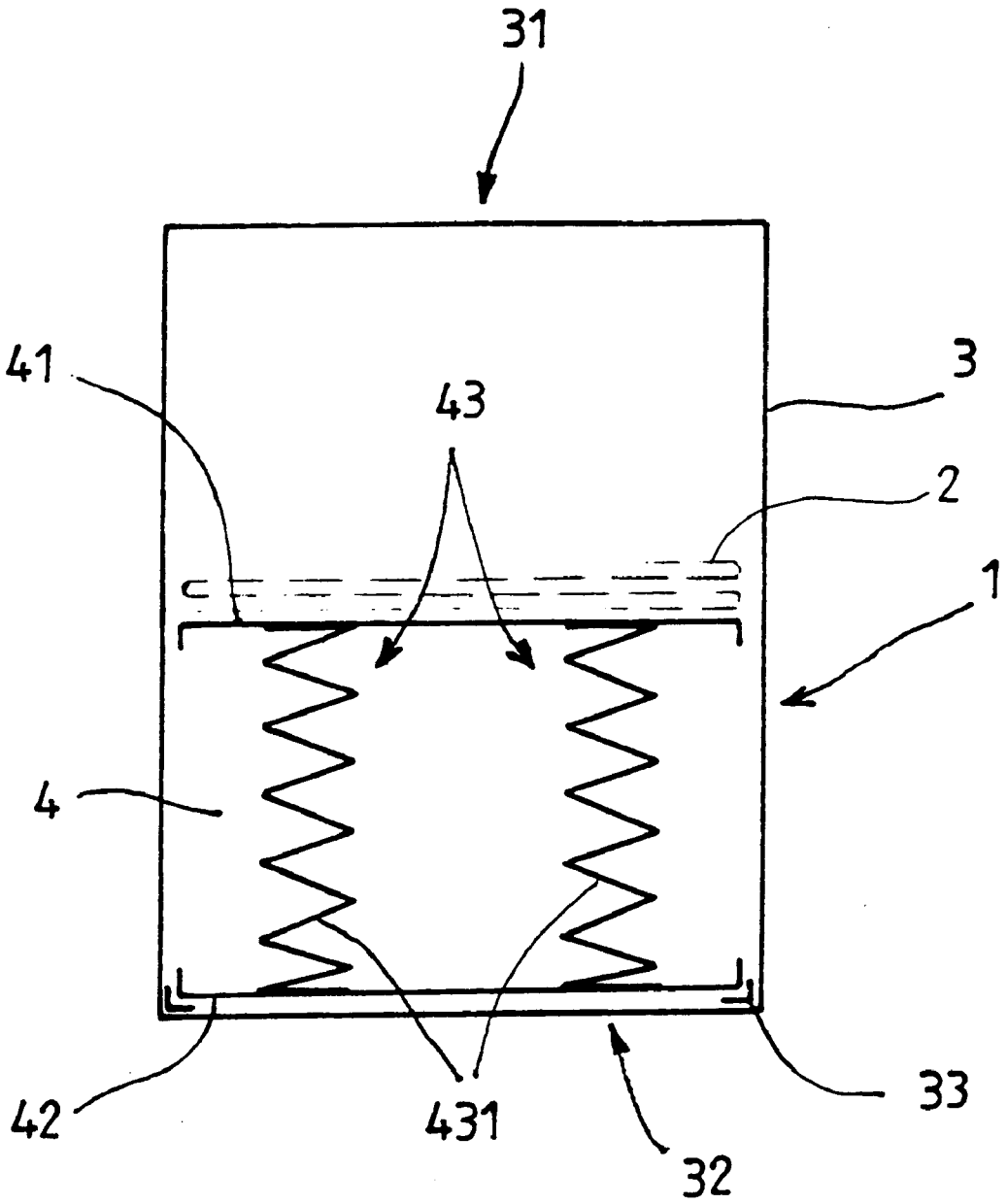

As the sliver 2 is being taken out of the flat container 1 in a sliver processing machine, for instance in a spinning machine, the decreasing weight of the sliver 2 still remaining the flat container 1, in combination with the action of the rings 431 of the auxiliary coupling means 43, continuously lifts the upper plate 41 up to its rest position at the maximum distance from the lower plate 42 while the lower plate 42 remains seated on the stops 31 in its lower position. As is shown in FIG. 5, the lifting movement of the upper plate 41 of the movable bottom 4 maintains the upper layer of the sliver 2 in the flat container 1 in a position accessible to the operator thus easily permitting him to find the sliver end in the flat container 1 after a possible sliver rupture and introducing it into the textile machine for resuming the sliver processing.

We claim:

1. A flat container of textile fibre sliver for receiving a sliver produced on a sliver producing textile machine and for feeding the sliver to a sliver processing machine taking over the sliver, the container comprising:

a movable bottom adapted to move vertically in the container, the movable bottom includes a vertically movable upper plate, and a vertically movable lower plate situated under the upper plate, the upper plate and the lower plate being mutually coupled by an auxiliary coupling means thereby the upper plate and the lower plate of the movable bottom being capable of a common motion and independent motion.

2. The flat container of textile fibre sliver as claimed in claim 1, wherein the auxiliary coupling means contains at least one resilient member situated between the upper plate and the lower plate of the movable bottom.

3. The flat container of textile fibre sliver as claimed in claim 2, wherein the auxiliary coupling means also comprises at least one spacing member situated between the upper plate and the lower plate of the movable bottom and defining at least a maximum distance between the upper plate and the lower plate.

4. The flat container of textile fibre sliver as claimed in claim 2, wherein the maximum distance between the upper plate and the lower plate of the movable bottom of the flat container lies within 30 to 70 percent of the height of the flat sliver container.

5. The flat container of textile fibre sliver as claimed in claim 3, wherein the maximum distance between the upper plate and the lower plate of the movable bottom of the flat container lies within 30 to 70 percent of the height of the flat sliver container.

6. The flat container of textile fibre sliver as claimed in claim 1, wherein the maximum distance between the upper plate and the lower plate of the movable bottom of the flat container lies within 30 to 70 percent of the height of the flat sliver container.

7. The flat container of textile fibre sliver for receiving a sliver produced on a sliver producing textile machine and for feeding the sliver to a sliver processing machine taking over the sliver, the container comprising: a movable bottom adapted to move vertically in the container, the movable bottom includes a vertically movable upper plate arranged, and a vertically movable lower plate situated under the upper plate, the upper plate and the lower plate being mutually coupled by an auxiliary coupling device thereby the upper plate and the lower plate of the movable bottom being capable of a common motion and independent motion.

* * * * *